US007117696B2

(12) United States Patent
Watanabe et al.

(10) Patent No.: US 7,117,696 B2
(45) Date of Patent: Oct. 10, 2006

(54) NEEDLE SELECTOR FOR KNITTING MACHINE

(75) Inventors: Kazuhisa Watanabe, Saitama (JP); Satoshi Enomoto, Saitama (JP)

(73) Assignee: WAC Data Service Kabushiki Kaisha, Fujimi (JP)

( * ) Notice: Subject to any disclaimer, the term of this patent is extended or adjusted under 35 U.S.C. 154(b) by 0 days.

(21) Appl. No.: 11/355,537

(22) Filed: Feb. 16, 2006

(65) Prior Publication Data

US 2006/0174662 A1 Aug. 10, 2006

Related U.S. Application Data

(63) Continuation of application No. PCT/JP04/06181, filed on Apr. 28, 2004.

(51) Int. Cl.
*D04B 15/78* (2006.01)

(52) U.S. Cl. ..... 66/218

(58) Field of Classification Search ..... 66/216, 66/217, 218, 219, 220, 221
See application file for complete search history.

(56) References Cited

U.S. PATENT DOCUMENTS 5,027,619 A * 7/1991 Saito ..... 66/218
5,823,015 A * 10/1998 Shibata ..... 66/218
6,220,062 B1 * 4/2001 Enomoto et al. ..... 66/218
6,526,784 B1 * 3/2003 Machida et al. ..... 66/218

FOREIGN PATENT DOCUMENTS

| | | | |
|---|---|---|---|
| EP | 0 185 766 | A1 | 7/1986 |
| EP | 0 210 790 | A2 | 2/1987 |
| JP | 62-28451 | A | 2/1987 |
| JP | 63-14106 | B2 | 3/1988 |
| JP | 6-94619 | B2 | 11/1994 |
| JP | 9-191134 | A | 7/1997 |
| JP | 2597189 | Y2 | 4/1999 |

* cited by examiner

*Primary Examiner*—Danny Worrell
(74) *Attorney, Agent, or Firm*—Frishauf, Holtz, Goodman & Chick, P.C.

(57) ABSTRACT

A needle selector for a knitting machine which selects a working needle by using a piezoelectric body having piezoelectric element is provided, in which an intermediate position between a rear end portion and front end portion of the piezoelectric body movably supported by a housing is rotatably held by the housing by using a rotary member to stabilize vibration of the piezoelectric body, a sectional structure of the rotary member 3 on a plane which is perpendicular to an axis of the rotary member 3 and perpendicular to a plane of the piezoelectric body is formed such that a bend in a widthwise direction of the piezoelectric body 2 is suppressed to be smaller than a bend in the longitudinal direction, so that a vibration speed and torque of the piezoelectric body further increase and energy saving is achieved.

6 Claims, 15 Drawing Sheets

NEEDLE SELECTOR FOR KNITTING MACHINE

This application is a continuation of PCT/JP04/06181 Apr. 28, 2004.

TECHNICAL FIELD

The present invention relates to a needle selector used in a knitting machine such as a circular knitting machine or flat knitting machine. More particularly, the present invention relates to a needle selector for a knitting machine in which the piezoelectric driving structure of a knitting machine is actuated while suppressing the bending movement of a piezoelectric member in a predetermined direction, so that working needles can be selected more efficiently.

BACKGROUND ART

In a knitting machine such as a circular knitting machine or flat knitting machine, the vertical movement of working needles is selected on the basis of a knitting procedure stored in a storage such as a floppy disk to form a fabric having a desired knitting texture. Various types of needle selectors are used to select the vertical movement of the working needles.

A needle selector of this type will be described. First, the outline of needle selecting operation in a knitting machine will be described through a circular knitting machine schematically shown in FIGS. 14, 15A, and 15B.

FIG. 14 is a schematic perspective view for explaining the basic knitting mechanism of a circular knitting machine. As shown in FIG. 14, in the circular knitting machine, working needles 52 are slidably arranged in a plurality of vertical grooves (not shown) formed along the longitudinal axis in the outer surface of a knitting cylinder 51 which rotates as indicated by an arrow A. As shown in FIGS. 15A and 15B, needle selection jacks 53 are arranged under the working needles 52 to be able to abut against the lower portions of the working needles 52. A cylindrical cam base 54*a* is set still under the knitting cylinder 51. A plurality of cams 54 each having a predetermined shape are arranged above the cam base 54*a* at a predetermined interval. The cams 54 push up the needle selection jacks 53 to push the working needles 52 upward.

The basic knitting principle is as follows. When a working needle 52 on the rotating knitting cylinder 51 is pushed upward through the needle selection jack 53, the working needle 52 projects from the upper surface of the knitting cylinder 51. A yarn 56 taken out from a yarn bobbin 55 is supplied to the hook of the projecting working needle 52 to form a yarn loop. Subsequently, the working needle 52 is moved downward by a known mechanism (not shown) to form one stitch. By selecting whether or not a vertical movement is to be applied to the working needle 52, a stitch may be formed, or may not be formed but the process advances to the next knitting step, thus forming a desired fabric. In order to actuate the working needles in this manner, in the knitting machine, generally, the needle selection jacks 53 are arranged under the working needles 52 to abut against the working needles 52. The needle selection jacks 53 are selectively engaged with the working needles 52 by using a needle selector 57, which operates on the basis of information from a controller 58 incorporating a storage that stores a knitting procedure for a knitting texture, to control the vertical movement of the working needles 52.

A case wherein a piezoelectric body is used as a needle selecting means will be described hereinafter with reference to FIGS. 15A and 15B which show the relationship among the working needle, selection jack, and needle selecting means.

A piezoelectric body 2 can be bent as shown in FIG. 15A or bent as shown in FIG. 15B in a direction opposite to that in FIG. 15A depending on how a voltage is applied to the piezoelectric body 2. A finger 5 is arranged to be connected to the front end of the piezoelectric body 2. The piezoelectric body 2, finger 5, and cam 54 are positioned as shown FIGS. 15A and 15B. The working needle 52 and needle selection jack 53 move circularly together with the knitting cylinder 51 (not shown) downward from the front side of the sheet of drawing to the back side of the sheet (or in the opposite direction). The needle selection jack 53 can swing about a fulcrum 53*a* as the center. A needle selection butt 69 and cam butt 70 are arranged so as to project from the needle selection jack 53 sideways as shown in FIGS. 15A and 15B.

When the piezoelectric body 2 is bent as shown in FIG. 15A, the needle selection butt 69 of the needle selection jack 53 which moves circularly collides against the finger 5. Consequently, the cam butt 70 of the needle selection jack 53 cannot engage with the cam 54. Hence, the needle selection jack 53 is not pushed upward by the cam 54, and the working needle 52 is not pushed upward.

When the piezoelectric body 2 is bent as shown in FIG. 15B, the finger 5 at the front end of the piezoelectric body 2 does not collide against the needle selection butt 69 of the needle selection jack 53 which moves circularly together with the knitting cylinder 51, and the needle selection jack 53 maintains the vertical posture. Consequently, the cam butt 70 at the lower end of the needle selection jack 53 is pushed upward along the inclined surface of the cam 54, and accordingly the working needle 52 is pushed upward.

When the needle selection butt 69 of the needle selection jack 53 and the finger 5 at the front end of the piezoelectric body 2 are engaged selectively in this manner, the working needle 52 can be moved upward freely as required, and a fabric having an arbitrary knitting texture can be knitted.

The most significant performance in knitting is high productivity, in other words, the capability of increasing the rotational speed of the knitting cylinder. To increase the rotational speed of the knitting cylinder 51, the needle selector 57 which controls the upward movement of the working needles 52 must be operated at a high speed. For this purpose, various types of needle selectors for knitting which operate at a high speed have been developed and used.

For example, the applicant of the present invention proposed a needle selector (see Japanese Patent Laid-Open No. 60-224845) in which the attraction or repulsion force of an electromagnet is used to enable a plurality of fingers to swing. This needle selector has a higher operation speed and smaller size than the conventional needle selector, thus achieving reduction of the power consumption. The applicant of the present invention also proposed a piezoelectric needle selector (see Japanese Patent Laid-Open No. 62-28451) to replace the needle selector using the electromagnet described above. According to this needle selector, the finger is actuated by bending a piezoelectric body to select a working needle. A higher operation speed, smaller size, and lower energy of the needle selector were achieved.

The applicant of the present invention also invented an improved apparatus of the piezoelectric needle selector described above, and filed it on Oct. 5, 1988, as Japanese Patent Application No. 63-249967 with the title "Needle Selector for Knitting Machine". This invention is registered as Japanese Patent No. 1969970 (see Japanese Patent Publication No. 6-94619), and its counterpart U.S. patent application is registered as U.S. Pat. No. 5,027,619.

FIG. 12A shows the piezoelectric needle selector described in Japanese Patent No. 1969970. As shown in FIG. 12A, according to the improved needle selector, a finger 5 is rotatably arranged on a piezoelectric body 2 having a piezoelectric element. Power is applied to the piezoelectric element to actuate the finger 5. A working needle of a knitting machine is selected by operation of the finger 5 (more particularly, through a jack) so that a fabric having a desired pattern texture can be knitted. According to the characteristic feature of this needle selector, the rear end portion of the piezoelectric body 2 is rotatably supported by a support A or housing through a rotary member 1A. The front end portion of the piezoelectric body 2 is rotatably connected to a U-shaped groove in the rear end portion of the finger 5 through a rotary member 1B. An intermediate position between the rear end portion and front end portion of the piezoelectric body 2 is clamped by rotary members 30 rotatably provided to a support body 13 or the housing. The finger 5 and piezoelectric body 2 are disposed on one straight line.

As shown in FIG. 12A, the intermediate portion of the piezoelectric body 2 is supported by the support body 13 through the rotary members 30. When the piezoelectric body 2 bends, it vertically moves a rear end 5A of the finger 5. The vertical movement of the rear end 5A vertically moves a front end 5B of the finger 5 which projects through an opening 19*a* of a support body 19. Consequently, the upward movement of a working needle 52 is selected.

The present applicant found that when the piezoelectric body 2 is rotatably supported at its predetermined position in this manner, the piezoelectric body 2 can bend freely. As a result, the moving speed of the finger 5 increases greatly and the moving amount of the front end of the finger 5 increases. When the piezoelectric body is used with this structure, damage to the piezoelectric body is decreased to prolong the service life of the needle selector. In this improved piezoelectric needle selector, as the structure of the finger actuating device which swings the finger member is improved greatly, the needle selecting ability is improved remarkably.

Basically, a piezoelectric body vibrates in all directions (360°) in a plane when power is applied to it. This is understandable from the fact that the piezoelectric body is originally introduced as a loudspeaker vibrating plate. When the piezoelectric body which vibrates in all directions is formed into a rectangular plate and one end of the long side of the plate is fixed, the plate forms a cantilevered beam the other end of which swings vertically. Even in this case, as the piezoelectric body vibrates in all directions, a vibration component in the widthwise direction of the rectangular piezoelectric body remains. Conventionally, a person skilled in the art overlooks this vibration component generated in the widthwise direction as inevitable.

In the conventional needle selector shown in FIG. 12A, the rotary member 30 which holds the piezoelectric body 2 at the intermediate position is a cylindrical member having a slit 32 extending from the end face of the rotary member 30 in the direction of longitudinal axis to hold the piezoelectric body 2, as shown in the detailed view of FIG. 12B. A shaft neck 31*a* at the end portion of the rotary member 30 and having a circular section is inserted in a circular hole (not shown) formed in the support body 13, so that the rotary member 30 is supported rotatably.

In the example shown in FIG. 12A, the rotary members 30 clamp the piezoelectric body 2 by the slits 32 from the left and right. Alternatively, as shown in FIG. 13, one cylinder 40 having a slit (not shown) at its central portion to clamp a piezoelectric body 2 may be used.

In this case as well, shaft necks 40*a* and 40*b* each having a circular section are inserted and held in the circular holes of the support body 13, so that the piezoelectric body 2 is supported rotatably.

In the conventional needle selector, as described above with reference to FIGS. 12B and 13, the cylinder that rotatably holds the piezoelectric body at the intermediate position is a cylindrical member having a circular section.

As described above, while the present inventors concentrate on an increase in operation speed, downsizing, and energy saving of a needle selector for a knitting machine and take various types of measures for these purposes to make results, a higher performance has yet been required.

In view of this, the present inventors have made extensive studies to obtain a more efficient swing movement with a piezoelectric body, and reached the following conclusion. Namely, as far as a cylindrical member having a circular section is used, it is difficult to let the vibration of a piezoelectric body focus in the longitudinal direction more efficiently. In particular, when the needle selector is further downsized, the diameter of the cylinder which rotatably holds the piezoelectric body at the intermediate position tends to decrease. The present inventors found that the smaller the diameter of the cylinder, the more apparently vibration tends to occur in the widthwise direction.

It is an object of the present invention to provide a needle selector having a novel structure for a knitting machine, which can suppress as much as possible a loss in swing movement of a piezoelectric body of a conventional needle selector for a knitting machine.

DISCLOSURE OF INVENTION

According to the present invention, there is provided a needle selector for a knitting machine, which comprises a plate-like piezoelectric body having a piezoelectric element and a finger aligned with the piezoelectric body and disposed to be movable, and in which a rear end portion of the piezoelectric body is rotatably supported in a groove of a support body or housing, a front end portion of the piezoelectric body is rotatably connected to a rear end portion of the finger, an intermediate position between the rear end portion and front end portion of the piezoelectric body is clamped by a rotary member rotatably provided to the support body or housing, and the finger is actuated by applying a voltage to the piezoelectric element to select a working needle of the knitting machine, so that a fabric having a predetermined pattern texture can be knitted, characterized in that the rotary member comprises shaft necks formed at two ends thereof to be supported by bearings provided to the support body or housing, and a central portion between the two shaft necks, and a slit which clamps the piezoelectric body is formed in at least part of the central portion in a widthwise direction of the piezoelectric body, and an axial sectional structure of the central portion on a plane which is perpendicular to an axis of the rotary member and perpendicular to a plane of the piezoelectric body is formed such that a bend in the widthwise direction of the piezoelectric body is suppressed to be smaller than a bend in a longitudinal direction of the piezoelectric body.

More specifically, according to the characteristic feature of the present invention, suppression of the bend in the widthwise direction caused by the piezoelectric body of the needle selector for the knitting machine according to the present invention is increased to be larger than suppression of the bend in the widthwise direction caused by the rotary member when the axial sectional structure of the central portion is made of the same material and forms a true circle.

In fine, the present invention is aimed at changing the sectional structure of the central portion of the rotary member to minimize as much as possible any movement other than a swing movement along the longitudinal direction of a piezoelectric plate which occurs upon application of a voltage. As described above, the diameter of the rotary member in the needle selector decreases as the result of the integration of various other technologies, and the piezoelectric body can be bent in the widthwise direction easily. Therefore, the necessity to suppress the bend in the widthwise direction more than the bend in the longitudinal direction of the piezoelectric body is assumed to increase more and more. According to the present invention, these problems can be solved.

An example of the simplest structure as the structure of the central portion includes one in which the sectional structure of the rotary member which is perpendicular to the axis has an elliptic shape having a short side in the longitudinal direction of the piezoelectric body. The sectional shape of the rotary member is not limited to an ellipse, but can be any shape as long as the length of the central portion along the longitudinal direction of the piezoelectric body is smaller than the length along the perpendicular direction of the piezoelectric body (direction perpendicular to the surface of the piezoelectric body). In particular, when the needle selector becomes more downsized in the future and the diameter of the rotary member decreases more, suppression of the vibration in the widthwise direction of the piezoelectric body becomes insufficient. Hence, in order to provide a larger suppressive force against the vibration in the widthwise direction of the piezoelectric body, it is effective if the section of the rotary member which holds the piezoelectric body at the intermediate position of the needle selector has a shape like, e.g., a train rail, that is, if the section has a rib-like projection, either or both on and under the central portion of the rotary member, at a position away from the slit.

According to another preferred embodiment, the central portion of the rotary member is formed of not less than two layers, in its sectional structure, which are made materials having different bending rigidities, and a material having a higher bending rigidity than a material used in a portion close to the slit is employed to form a portion away from the slit. In this case, as the materials of the two layers, for example, plastic materials having different bending rigidities may be used. Alternatively, a plastic material may be used to form the portion close to the slit, and a metal material such as steel may be used to form the portion away from the slit.

In this manner, the structure of the rotary member of the present invention can be achieved by two methods, i.e., by changing the shape of the rotary member in a section perpendicular to the axis of the rotary member and by partially changing the material used in the perpendicular section, and by the combinations of the two methods.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the present invention and, together with the description, serve to explain the principles of the invention.

FIGS. 3A and 3B are views showing an example of a rotary member, in the needle selector for the knitting machine of the embodiment, which holds a piezoelectric body at an intermediate position, in which FIG. 3A is a perspective view, and FIG. 3B is a view seen from the direction of a rotation axis;

FIGS. 4A and 4B are views showing another example of the rotary member, in the needle selector for the knitting machine of the embodiment, which holds the piezoelectric body at the intermediate position, in which FIG. 4A is a perspective view, and FIG. 4B is a view seen from the direction of a rotation axis;

FIGS. 5A to 5C are views showing still another example of the rotary member, in the needle selector for the knitting machine of the embodiment, which holds the piezoelectric body at the intermediate position, in which FIG. 5A is a perspective view, FIG. 5B is a cross-sectional view taken along the line A—A of FIG. 5A, and FIG. 5C is a cross-sectional view of a modification of the example shown in FIG. 5B;

FIGS. 7A and 7B are views showing still another example of the rotary member, in the needle selector for the knitting machine in the embodiment, which holds the piezoelectric body at the intermediate position, in which FIG. 7A is a perspective view, and FIG. 7B is a view seen from the direction of a rotation axis;

FIGS. 8A and 8B are views showing an example of the rotary member, in the needle selector for the knitting machine in the embodiment, which is known itself and rotatably supports the rear end portion of the piezoelectric body in the groove of a support body or housing, in which FIG. 8A is a perspective view of the rotary member, and FIG. 8B is a view showing the rotary member in relation to the support;

FIGS. 10A to 10C are perspective views showing examples of a rotary body, in the needle selector in the embodiment and a conventional needle selector, which holds the piezoelectric body at the intermediate position, in which FIGS. 10A and 10B are views showing conventional examples, and FIG. 10C is a view showing an example of the present invention;

FIGS. 12A and 12B are views showing an example of a conventionally known needle selector for a knitting machine, in which FIG. 12A is a perspective view, and FIG. 12B is a perspective view showing an example of a rotary member which holds, at an intermediate position, a piezoelectric body used in the needle selector shown in FIG. 12A;

FIGS. 15A and 15B are schematic views showing the relationship between the bend of a piezoelectric body and the vertical movement of a working needle in a needle selector for a knitting machine, in which FIG. 15A is a schematic view showing a case wherein the working needle is not actuated by a cam, and FIG. 15B is a view showing a case wherein the working needle is actuated by a cam.

BEST MODE FOR CARRYING OUT THE INVENTION

The present invention will be described in detail hereinafter with reference to the accompanying drawings which show a needle selector for a knitting machine according to an embodiment of the present invention.

Figure 1:
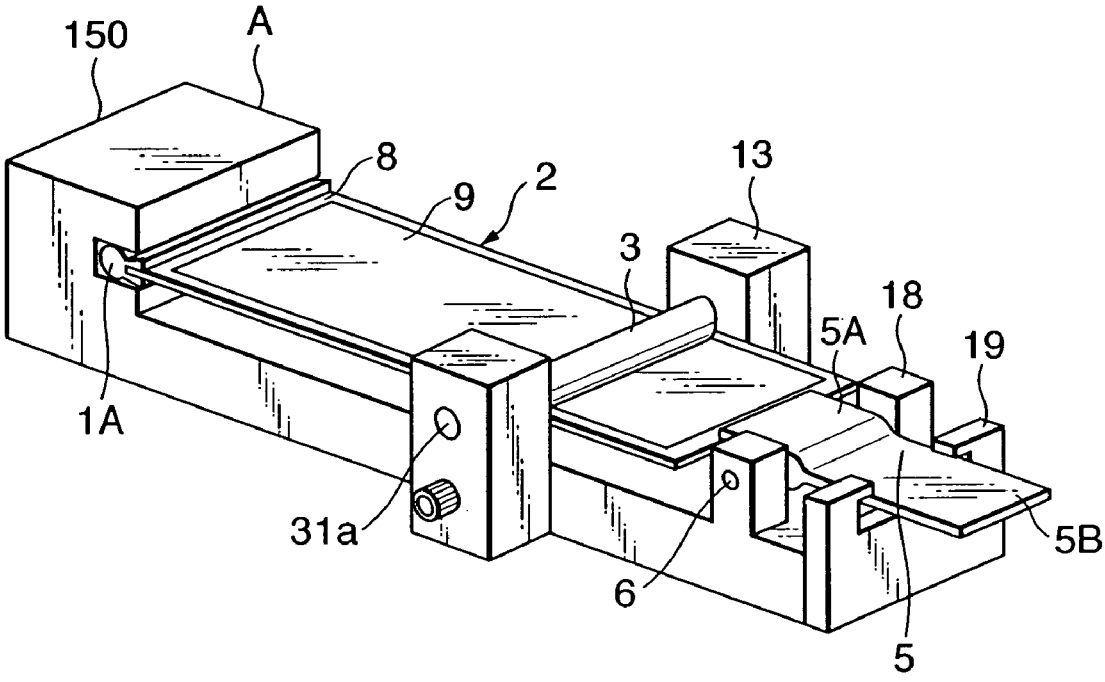
FIG. 1 is a perspective view showing the structure of a needle selector for a knitting machine according to an embodiment of the present invention.
Figure 2:
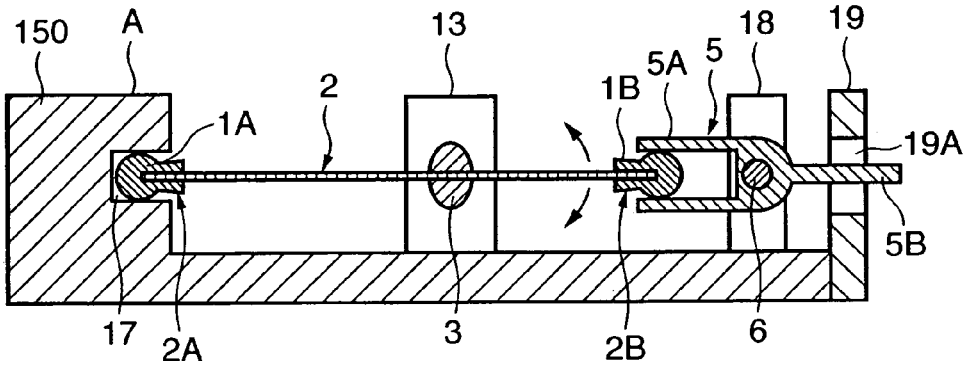
FIG. 2 is a central longitudinal sectional view of the needle selector for the knitting machine shown in FIG. 1.

FIG. 1 is a perspective view of a needle selector for a knitting machine according to an embodiment of the present invention, and FIG. 2 is a central longitudinal sectional view of the needle selector for the knitting machine shown in FIG. 1.

Figure 8A:
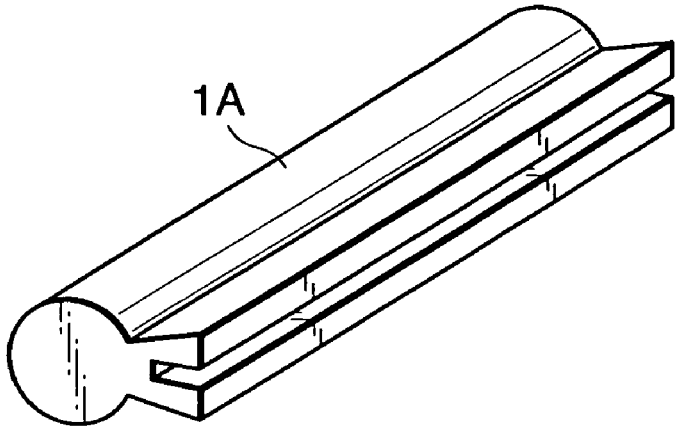

As shown in FIGS. 1 and 2, a rear end portion 2A, to which a spherical body 1A is attached, of a piezoelectric body 2 is inserted in a groove 17 of a support portion 150, which supports the rear end portion of the piezoelectric body 2, of a support body A. FIG. 8A shows a perspective view of the spherical body 1A.

Figure 8B:
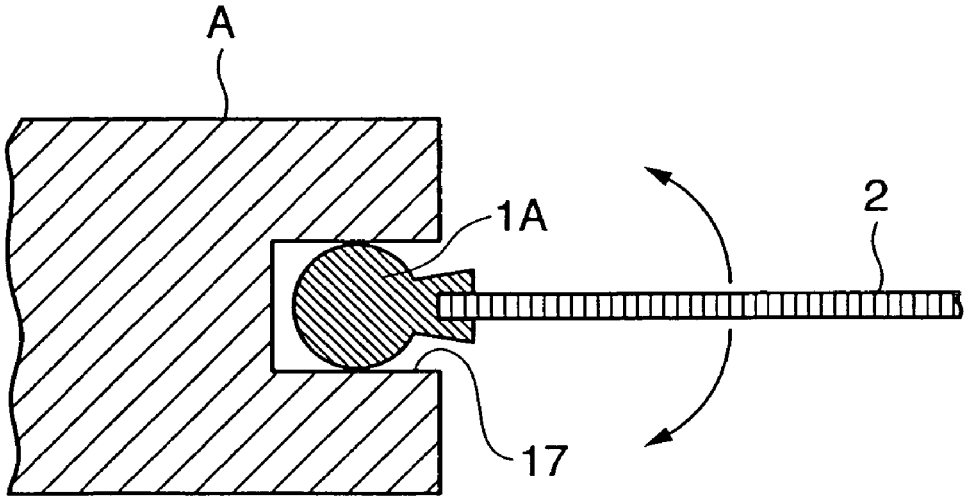

A groove is formed in the end portion of the spherical body 1A. The end portion of the piezoelectric body 2 is inserted and fixed in this groove. As shown in FIG. 8B, as the spherical portion of the spherical body 1A can rotate in the groove 17 of the support body, the rear end portion 2A of the piezoelectric body 2 can rotate upward or downward, as indicated by arrows in FIG. 8B.

A spherical body 1B similar to that attached to the rear end portion of the piezoelectric body 2 is attached to a front end portion 2B of the piezoelectric body 2. The spherical body 1B is clamped and connected by the open end portion of a rear end portion 5A of a finger 5. The spherical body 1B can also rotate upward or downward in the rear end portion 5A of the finger 5, as indicated by arrows in FIG. 2.

Figure 9A:
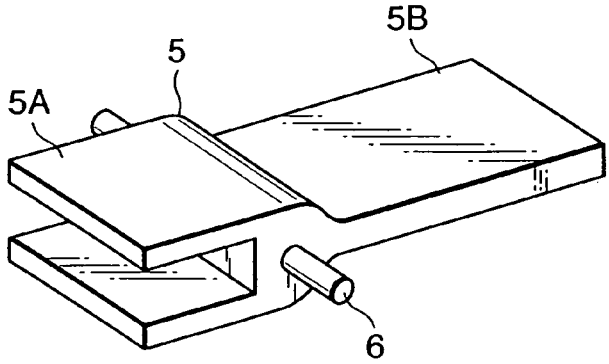
FIG. 9A is a perspective view of a finger, in the needle selector for the knitting machine in the embodiment, which is known itself and is rotatably connected to the finger through the front end portion of the piezoelectric body.

As shown in FIG. 9A, the rear end portion 5A of the finger 5 has a hole in the widthwise direction of the finger 5, and a finger fixing portion 18 of the support body A also has a corresponding hole. A shaft 6 is inserted in the two holes to rotatably fix the finger 5 to the fixing portion 18. The finger 5 is connected to the piezoelectric body 2 to be aligned (in the same direction) with the rectangular piezoelectric body 2. A front end portion 5B of the finger 5 projects from an opening 19A of an open wall 19 of the support body A which vertically stands at a position remote from the finger fixing portion 18.

The opening 19A is formed to have a width and height conforming to a process that takes place when the finger 5 moves vertically. The finger 5 follows the bending movement of a plate 8 caused by a piezoelectric element 9 to engage with or disengage from the butt of a needle selection jack which is arranged to abut against a working needle or the lower end of the working needle.

Figure 9B:
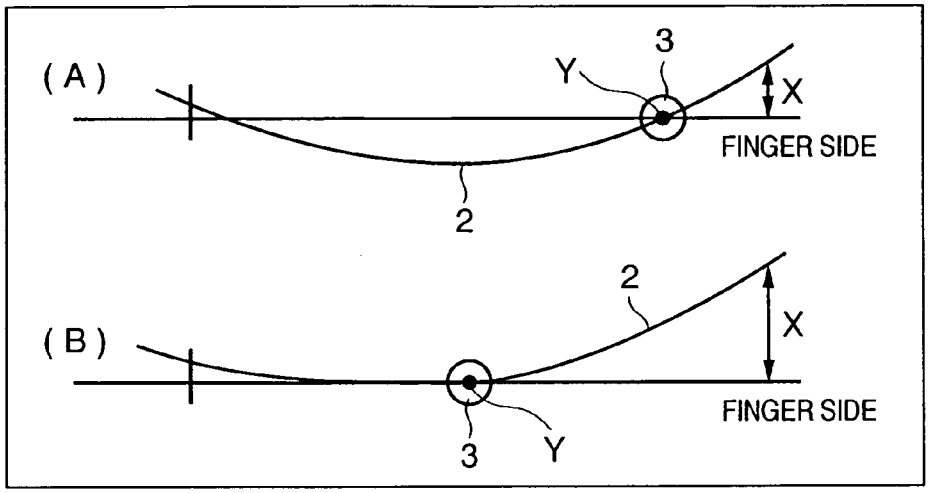
FIG. 9B is a view showing the strokes of the front end portion of the piezoelectric body on the finger side, in the needle selector for the knitting machine in the embodiment, which is influenced by the positional shift of the rotary member at an intermediate position in the bending movement of the piezoelectric body.

An intermediate position Y (see FIG. 9B) between the rear end portion 2A and front end portion 2B of the piezoelectric body 2 is clamped by a rotary member 3 provided to an intermediate fulcrum portion 13 of the support body A. The piezoelectric body 2 tries to bend about the intermediate position Y as a fulcrum. As shown in (A) of FIG. 9B, the closer to the finger side, the faster the vibrating speed of the finger. Then, although an amplitude X decreases, the torque increases. As shown in (B) of FIG. 9B, when the piezoelectric body 2 is moved away from the finger, an opposite phenomenon occurs. Although the amplitude X increases, the torque decreases.

The intermediate position Y where the piezoelectric body 2 is clamped by the rotary member 3 is preferably at a position of ⅓ to ⅔ the entire length of the piezoelectric body 2 from the rear end portion 2A of the piezoelectric body 2.

As the rotary member 3, conventionally, a rod-shaped member having a circular section is used, as described above (see FIGS. 12B and 13). If a rotary member is to be used only to provide an intermediate fulcrum to the piezoelectric body 2 so that bending movement becomes easy, any other rod-shaped member suffices as far as the shaft neck of the rotary member is rotatable with respect to the support body A, and no restriction is put at all on the sectional structure of the central portion of the rotary member. Hence, it is only natural that a rod-shaped member having a circular section throughout its entire length, which was then available the most easily, was used as a rotary member.

Various types of examples of the structure of the rotary member 3 as the main part of the present invention will be described with reference to FIGS. 3A, 3B, 4A, 4B, 5A, 5B, 5C, 6, 7A, and 7B.

Figure 3A:
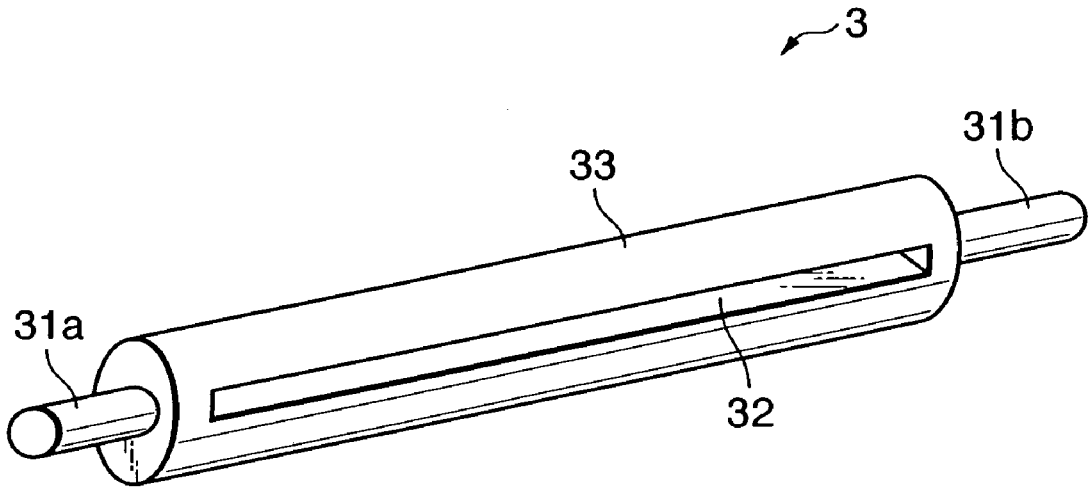
Figure 3B:
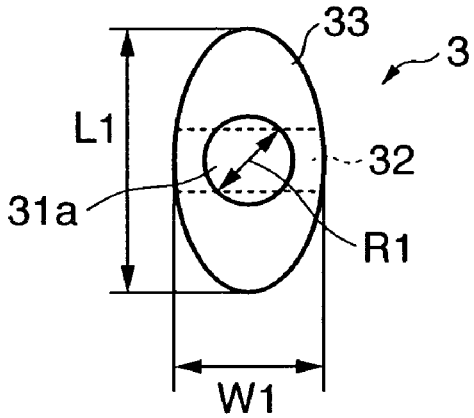

FIG. 3A (perspective view) shows the first example of the rotary member 3, FIG. 3B shows it from the axial direction. A rotary member 3 according to the first example has shaft necks 31*a* and 31*b* at its two ends, and its central portion 33 has an elliptic section with a major axis L1 and minor axis W1. A through hole 32 to clamp the piezoelectric body 2 is formed in the side portion of the central portion 33. As is apparent from FIG. 3B, that section of the central portion 33 of the rotary member 3 which is perpendicular to the axial direction is an ellipse. From the shape of the central portion 33 and the position of the through hole 32 shown in FIG. 3B, it is apparent that the major axis of the ellipse extends on a section perpendicular to the axis of the rotary member 3, in a direction perpendicular to the plane of the piezoelectric body 2. Consequently, it is understood that with this structure, the bend of the piezoelectric body 2 along the widthwise direction is suppressed to be smaller than the bend of the piezoelectric body 2 along the longitudinal direction. According to this example, a diameter R1 of the shaft neck 31*a* is smaller than the minor axis W1 of the central portion 33.

Figure 4A:
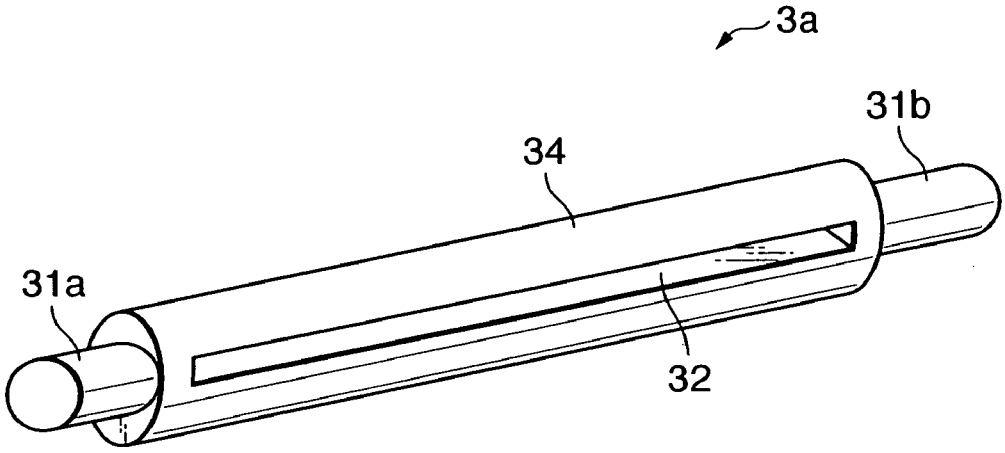
Figure 4B:
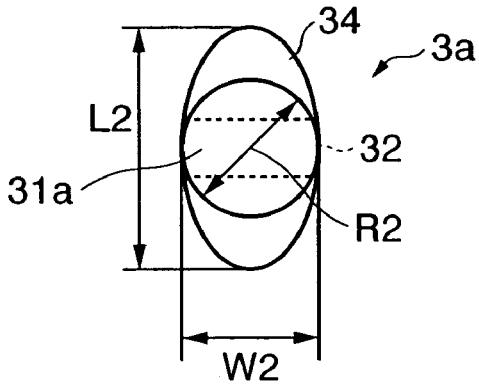

FIG. 4A is a perspective view of a rotary member 3*a* according to the second example, and FIG. 4B is a view of the same seen from the axial direction. In the rotary member 3*a*, a diameter R2 of a shaft neck 31*a* is equal to a minor axis W2 of a central portion 34.

In both the first and second examples, the ratio of the major axis to the minor axis is selected depending on in what range the vibration of the piezoelectric body 2 in the widthwise direction is to be suppressed.

Figure 5A:
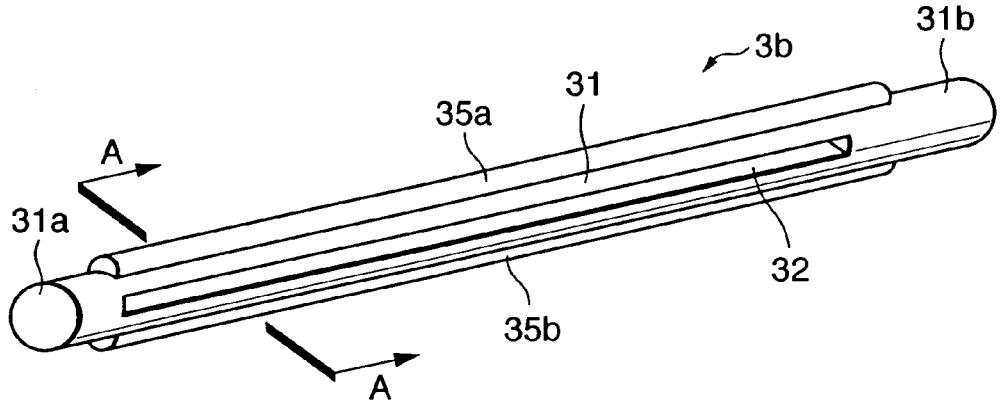
Figure 5B:
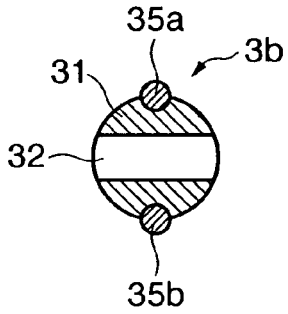

FIG. 5A is a perspective view of a rotary member 3*b* according to the third example, and FIG. 5B is a cross-sectional view of the same. In this rotary member 3*b*, the two ends of a cylindrical member 31 form shaft necks 31*a* and 31*b*. Rod-shaped members 35*a* and 35*b* made of a metal, e.g., steel, having a higher rigidity than the material of the member 31 are arranged on a portion of the member 31, which is parallel to the plane of a piezoelectric body 2 which is to be inserted in a through hole 32 at the central portion of the member 31. According to the third example, the rod-shaped members 35*a* and 35*b* may be arranged to be pushed into the surface of the member 31. Alternatively, as in a rotary member 3*c* of the fourth example shown in the sectional view of FIG. 5C, rod-shaped members 36*a* and 36*b* may be adhered to the outer surface of a member 31. In both the third and fourth examples, for example, a rod-shaped member may be arranged only on one side of the surface of the section. More specifically, either the upper or lower rod-shaped member 35*a* or 35*b* (or rod-shaped member 36*a* or 36*b*) may be arranged. The material of the rod-shaped members 35*a*, 35*b*, 36*a*, and 36*b* is not limited to a metal. A material having a higher bending rigidity than that of the member 31 may be used to form the portions 35*a*, 35*b*, 36*a*, and 36*b*. When a material having a bending rigidity much higher than that of the member 31 is used to form the portions 35*a*, 35*b*, 36*a*, and 36*b*, the proportion of the rod-shaped member can be decreased.

Figure 6:
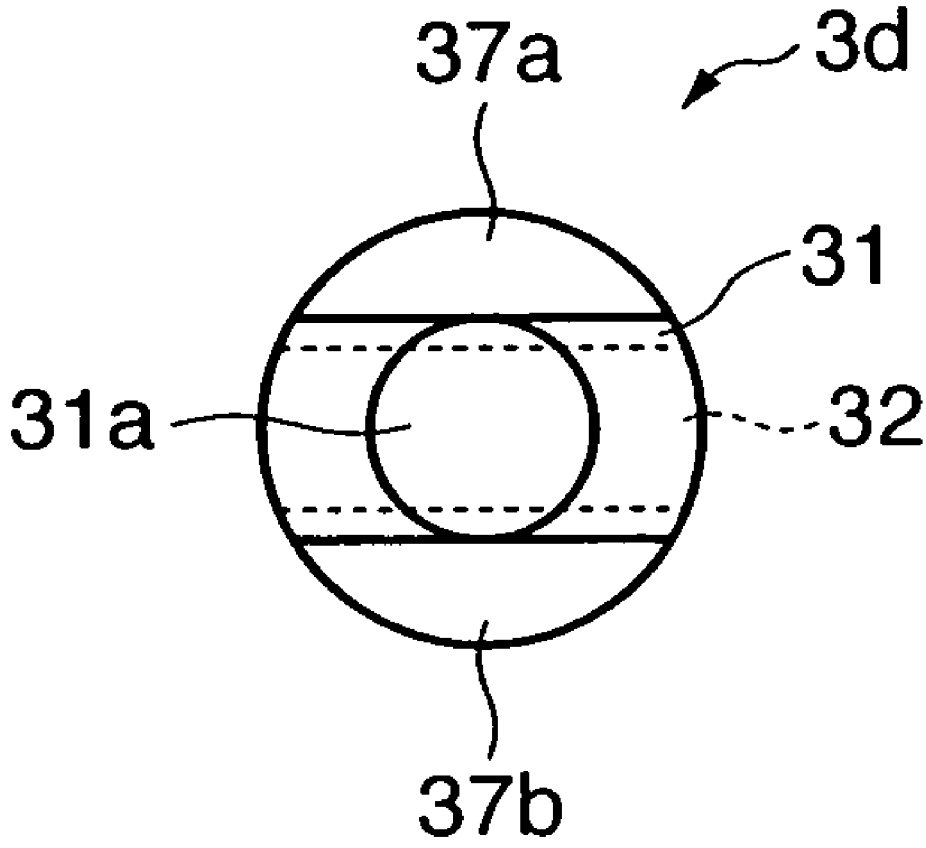
FIG. 6 is a view showing still another example of the rotary member, in the needle selector for the knitting machine of the embodiment, which holds the piezoelectric body at the intermediate position, and shows a state seen from the direction of a rotation axis.

A rotary member 3*d* according to the fifth example shown in FIG. 6 is formed by injection-molding two materials having different bending rigidities using, e.g., a coinjection molder. In this case, preferably, polyacetal is used to form a portion 31, and a resin material having a higher bending rigidity than a polyacetal resin, e.g., a composite resin material obtained by reinforcing a resin such as a polyacetal resin with glass fiber or the like, is used to form portions 37*a* and 37*b*.

Figure 7A:
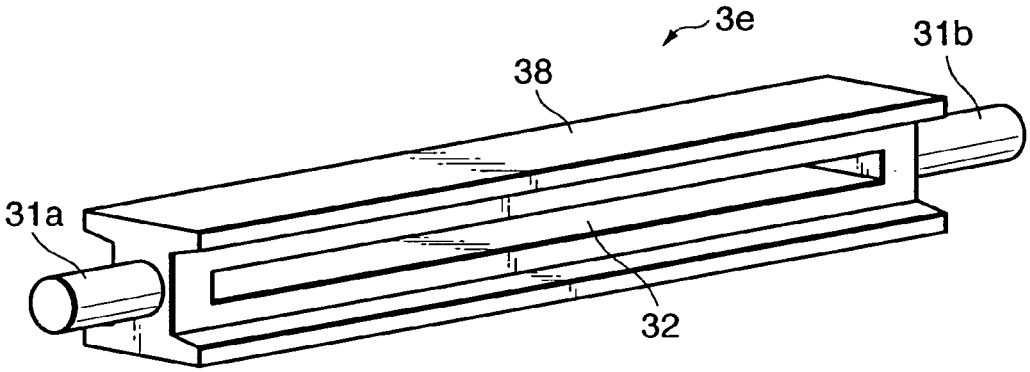
Figure 7B:
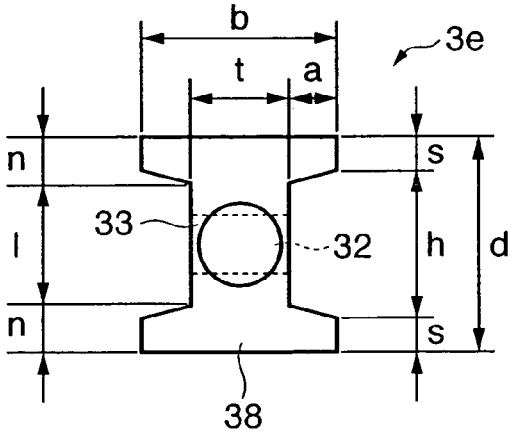

FIG. 7A is a perspective view of a rotary member 3*e* according to the fifth example, and FIG. 7B is a view of the same seen from the direction of a rotation axis. In the rotary member 3*e*, a central portion 38 is formed to have an I-shaped section like a train rail as shown in FIG. 7B, and shaft necks 31*a* and 31*b* are arranged at the two ends of the central portion 38. In this case, the central portion 38 and the shaft necks 31*a* and 31*b* are preferably made of the same material by injection molding. As shown in FIG. 7B, an I-shaped section includes different portions in its shape. When the sizes of the respective portions are changed in various manners, the bending rigidity can be greatly changed, as shown by calculation examples to be described later.

As described above in detail in the various examples, according to the characteristic feature of the needle selector for the knitting machine according to this embodiment, the piezoelectric body is clamped by the rotary member 3 only at one point at the intermediate position between the rear end portion and front end portion of the piezoelectric body 2, and the axial section of the rotary member at this only one point has a particular structure, so that the bend in the widthwise direction of the piezoelectric body is suppressed.

The structure of the rotary member 3 was changed among those with the conventional circular section and various types of elliptic shapes and various types of I-shaped sections of the present invention, and the obtained calculation results of the changes in bending rigidity are shown below.

Calculation Formula

Sectional Area

| | |
|---|---|
| Circle | $\pi d^2/4$ |
| Ellipse | $\pi \times \{0.5 \times (\text{major axis})\} \times \{0.5 \times (\text{minor axis}\}$ |
| I shape | $d \cdot t + 2a(s + n)$ (see FIG. 7B) |

Secondary Moment of Section

| | |
|---|---|
| Circle | $I = \pi d^4/64$ |
| Ellipse | $I = \pi \times \{0.5 \times (\text{major axis})\}^3 \times \{0.5 \times (\text{minor axis})\}$ |
| I shape | $g = (h - 1) \div (b - t)$ |

Tables 1, 2, and 3 show the obtained calculation results.

TABLE 1

| Calculative Example | Sectional Shape | Diameter R1 | Radius r | Minor Axis | Major Axis | Sectional Area | Areal Ratio to 1 | Secondary Moment I of Section | Ratio of I to 1 |
|---|---|---|---|---|---|---|---|---|---|
| 1 (Prior Art) | circle | 10 | 5 | — | — | 78.5 | — | 490 | — |
| 2 | ellipse | — | — | 8 | 12.5 | 78.5 | 1.0 | 575 | 1.17 |
| 3 | ellipse | — | — | 6 | 16.7 | 78.5 | 1.0 | 1361 | 2.77 |
| 4 | ellipse | — | — | 10 | 12 | 90.4 | 1.15 | 848 | 1.73 |
| 5 | ellipse | — | — | 10 | 14 | 110 | 1.40 | 1346 | 2.74 |

Table 1 shows the sectional areas and the values of the secondary moment I of the section of the rotary member of a case wherein the rotary member has a conventional circular section and cases wherein the rotary member has various types of elliptic sections according to the present invention. For the calculative convenience, assume that the conventional circular section has a diameter of 10 mm. Calculations are made through comparison with this case.

As is apparent from Table 1, in the case of the circle (prior art), the sectional area is 78.5 $mm^2$, and I is 490. In the cases of ellipses, assuming that the sectional area is equal to that of the circle, when the minor axis is 8 mm (calculation example 2), I is merely 1.17 times that of the circle. When the minor axis is 6 mm (calculation example 3), I becomes 2.77 times, and the bending rigidity is improved greatly.

Trial calculation (calculation examples 4 and 5) is performed as to how much I is improved by increasing the major axis while the minor axis is 10 mm, which is equal to that of the circle (prior art). When the major axis is 12 mm, I is 1.73 times; when 14 mm, I is 2.74 times.

Table 2 shows the shapes and sizes of three calculation examples 6, 7, and 8 when the rotary member has an I-shaped section. Table 3 shows the respective sectional areas and I values of the three calculation examples 6, 7, and 8.

TABLE 2

| Calculative | Sizes of Respective Portions of Rail-Like I-shaped Section (See FIG. 7B) | | | | | | | |
|---|---|---|---|---|---|---|---|---|
| Example | b | T | a | d | h | l | s | n |
| 6 | 8 | 4 | 2 | 12 | 6 | 4 | 3 | 4 |
| 7 | 10 | 6 | 2 | 12 | 6 | 4 | 3 | 4 |
| 8 | 10 | 6 | 2 | 14 | 8 | 6 | 3 | 4 |

TABLE 3

| Calculative Example | Sectional Area | Areal Ratio to 1 | Secondary Moment I Of Section | Ratio of I to 1 |
|---|---|---|---|---|
| 6 | 76 | Substantially equal | 1109 | 2.26 |
| 7 | 100 | 1.27 | 1396 | 2.84 |
| 8 | 112 | 1.42 | 2170 | 4.43 |

The calculation examples of the rotary members having I-shaped sections include a case (calculation example 6) wherein the sectional area is substantially equal to that of calculation example 1 (circular section) and cases (calculation examples 7 and 8) wherein the value of b, that is, the width of the I-shaped section in the longitudinal direction of the piezoelectric body 2 is set equal to the diameter of calculation example 1.

It is apparent from Table 3 that in any example, when an I-shaped section was employed, the I value could be largely increased than in a case wherein any other section was used.

Figure 10A:
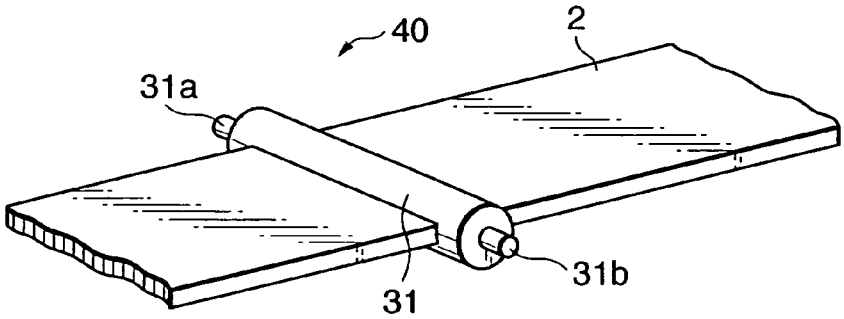
Figure 10B:
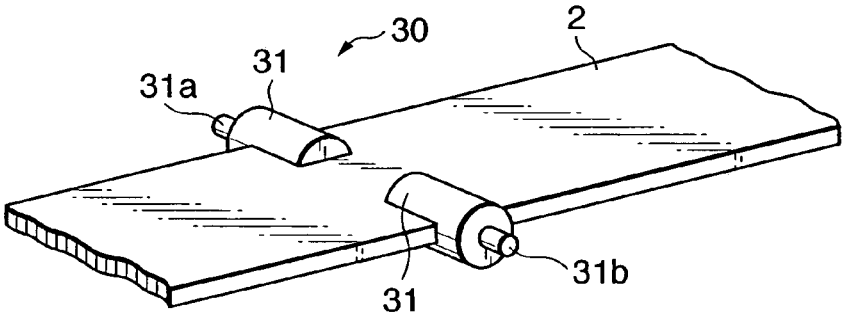
Figure 10C:
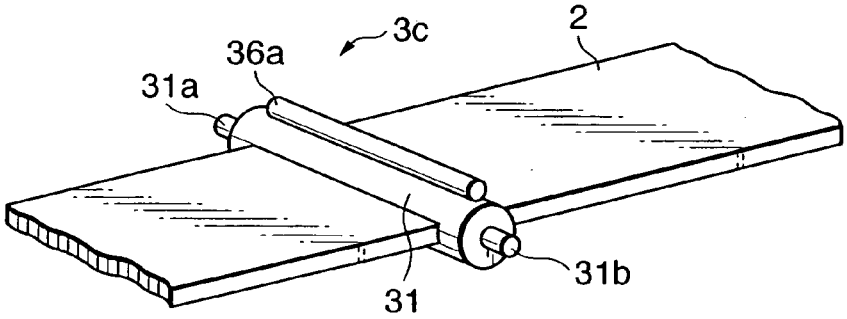

Subsequently, samples of the rotary members of the prior art and the examples of the present invention were made. Each sample was combined with a piezoelectric body to perform vibration test in accordance with the actual needle selecting operation. FIGS. 10A, 10B, and 10C show schematic perspective views of the employed rotary members.

Figure 5C:
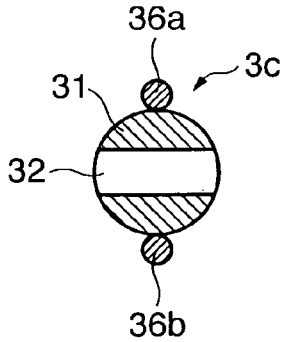
Figure 12A:
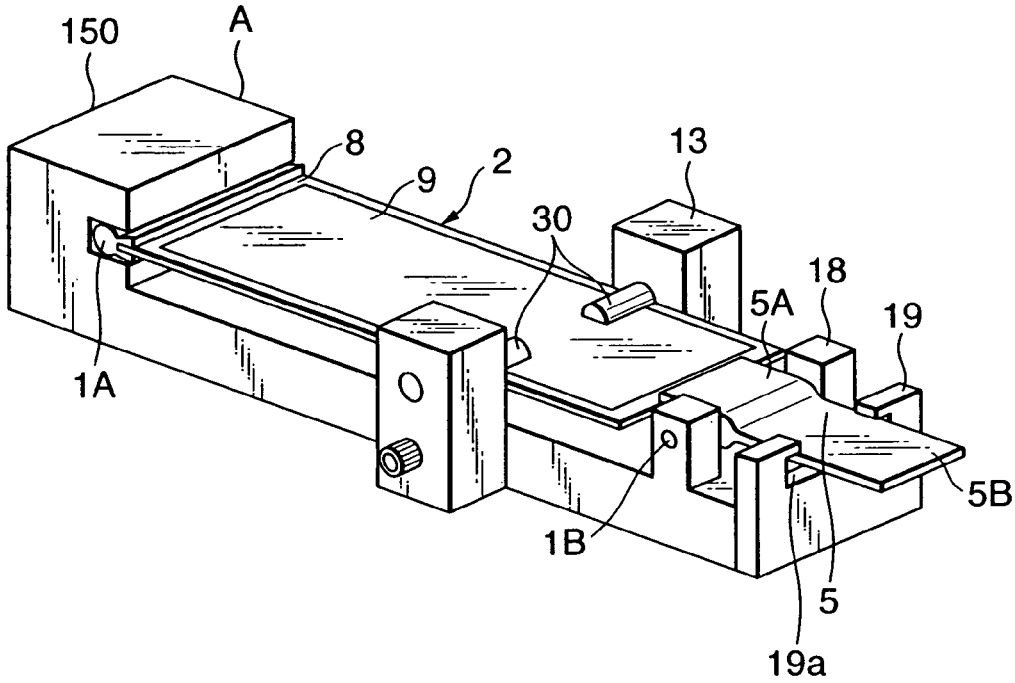
Figure 12B:
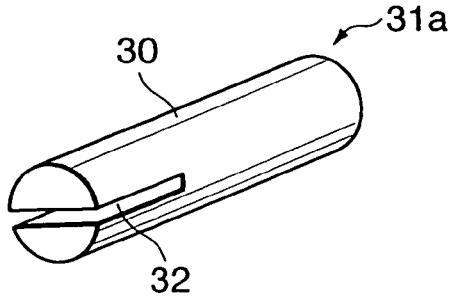
Figure 13:
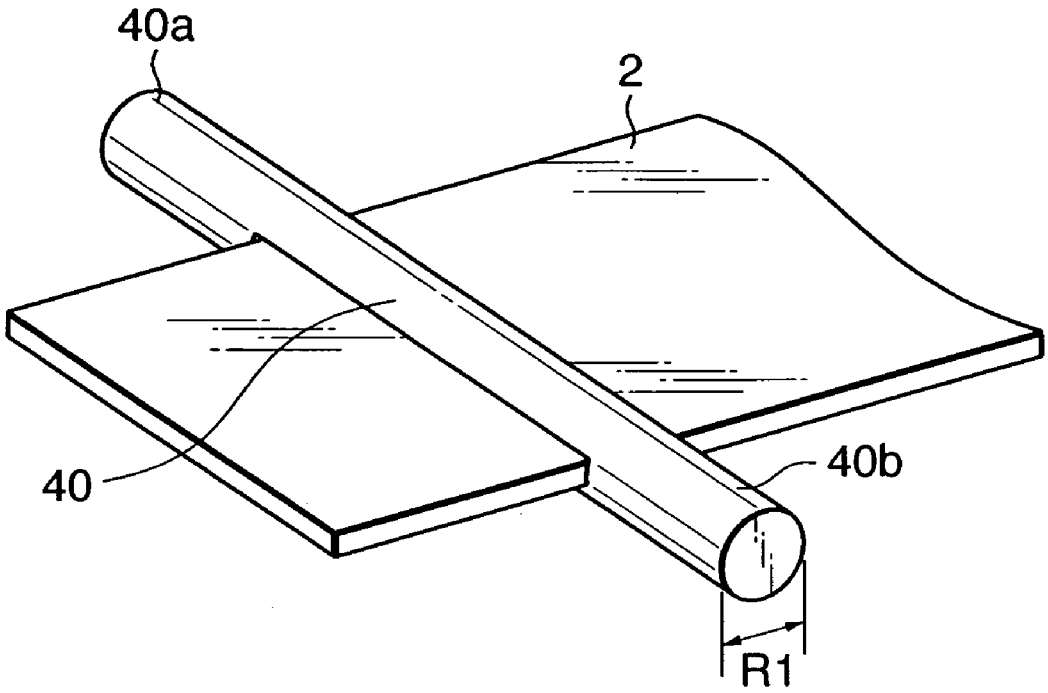
FIG. 13 is a perspective view showing another conventional rotary member, used in the conventionally known needle selector for the knitting machine, in relation to the piezoelectric body.
Figure 14:
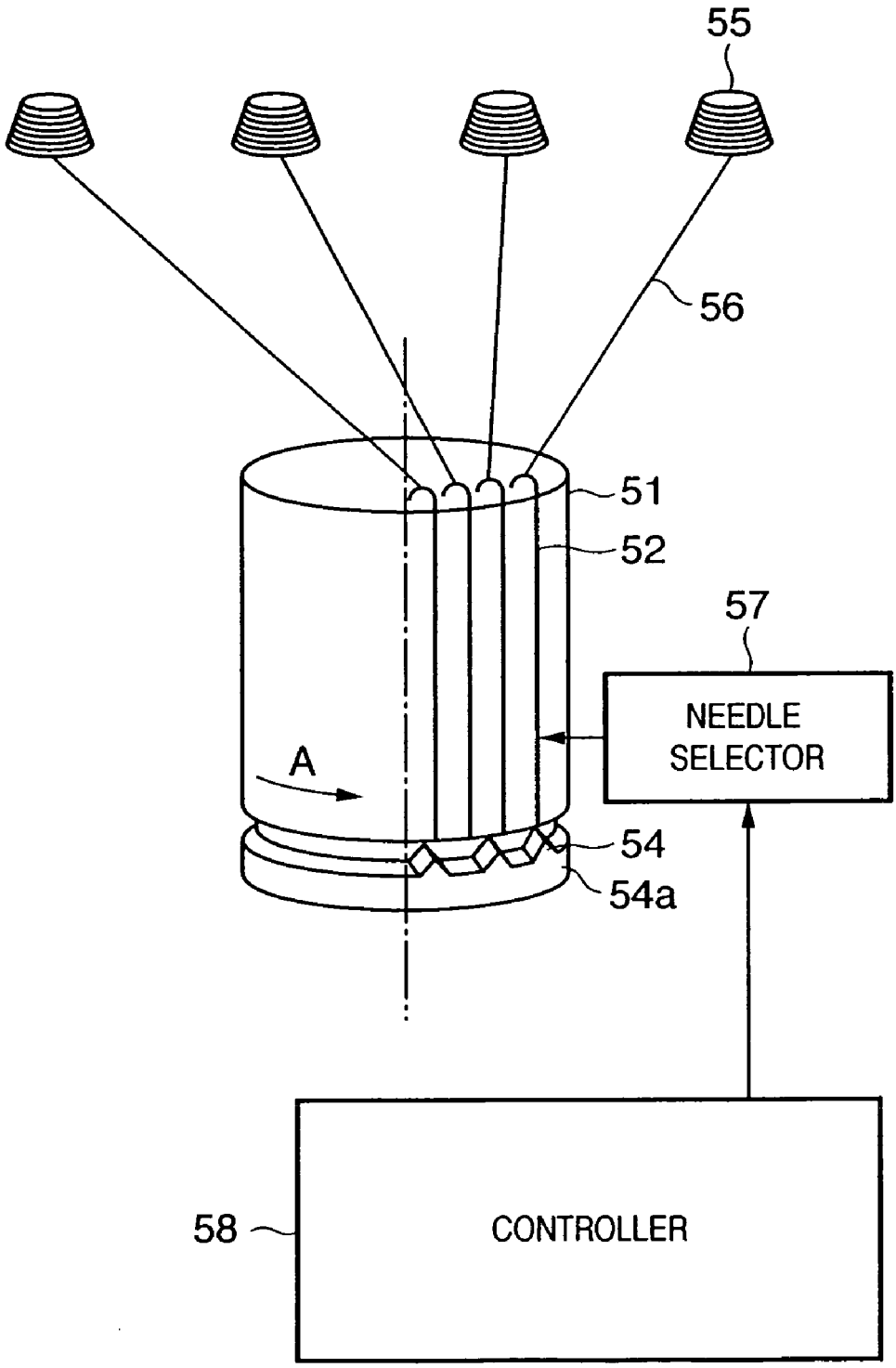
FIG. 14 is a schematic view for explaining the vertical movement of working needles which is provided by a pattern knitting mechanism in a circular knitting machine.
Figure 15A:
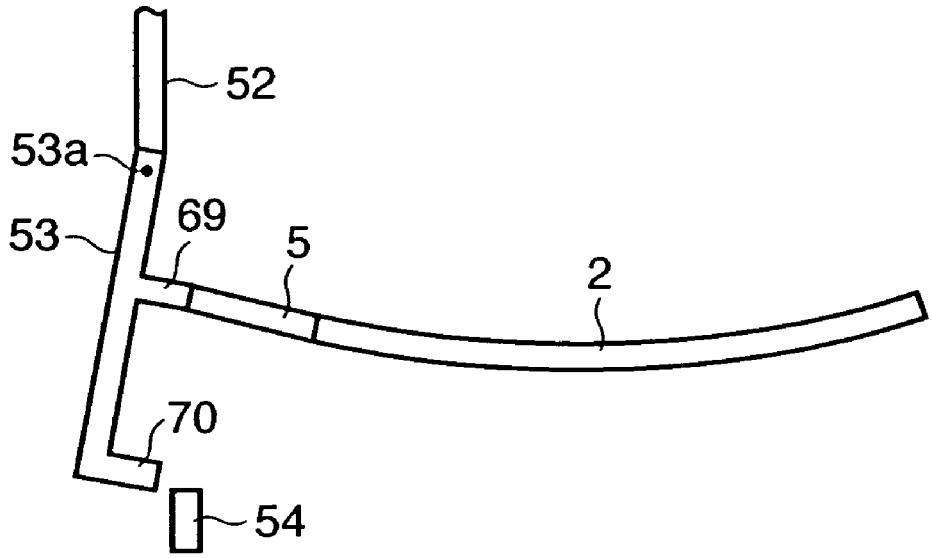
Figure 15B:
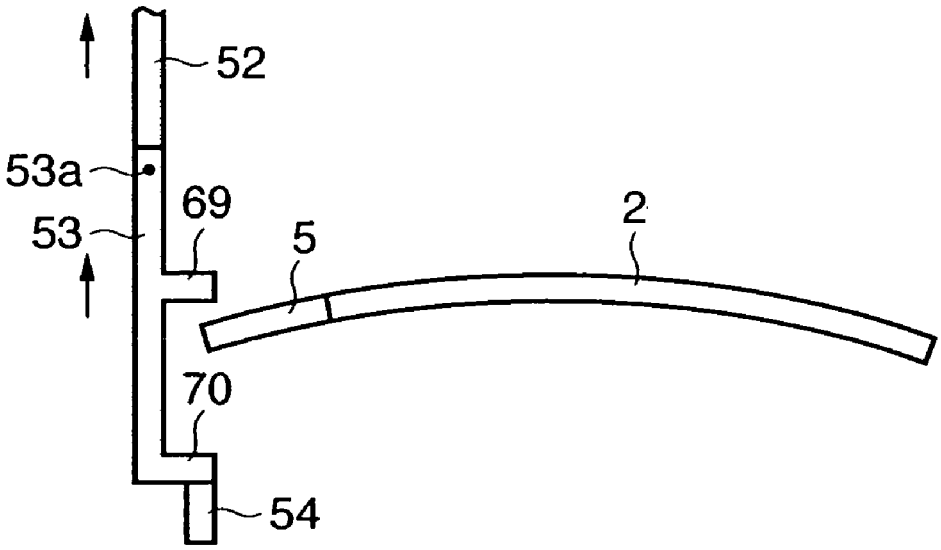

The rotary member of FIG. 10A is the rotary member shown in FIG. 13 which is conventionally widely used in the needle selector, and the rotary member of FIG. 10B is a rotary member of a type which supports the piezoelectric body 2 shown in FIGS. 12A and 12B from two sides. FIG. 10C shows an example of the present invention the detailed structure of which is shown in FIG. 5C. Rod-shaped members 36*a* are arranged on the two, upper and lower sides of a central portion 31.

The experiment was conducted in the following manner. The rotary members described above were combined with piezoelectric bodies to fabricate three samples for each of comparative example 1 the structure of which is shown in FIG. 10A, comparative example 2 the structure of which is shown in FIG. 10B, and this example. The respective samples were subjected to a vibration test. As the piezoelectric body 2, one having a width of 10 mm and a length of 30 mm was used. The rotary member 30 was made of a polyacetal resin to have a diameter of 2.5 mm. The rod-shaped member 36*a* was made of stainless steel to have a diameter of 0.3 mm.

Table 4 shows the obtained test results.

TABLE 4

| | Sample No. | A UP Torque | B DW Torque | C Total Stroke |
|---|---|---|---|---|
| Comparative Example 1 FIG. 10A | 1 | 0.39 | 0.31 | 1.14 |
| | 2 | 0.41 | 0.36 | 1.27 |
| | 3 | 0.38 | 0.34 | 1.20 |
| Comparative Example 2 FIG. 10B | 4 | 0.28 | 0.26 | 1.00 |
| | 5 | 0.32 | 0.23 | 1.01 |
| | 6 | 0.29 | 0.25 | 0.95 |
| Example FIG. 10C | 7 | 0.44 | 0.35 | 1.29 |
| | 8 | 0.42 | 0.37 | 1.32 |
| | 9 | 0.43 | 0.34 | 1.28 |

| | Sample No. | D (A × C) | E (B × C) | F (D + E)/2 | Average Value of F | Difference |
|---|---|---|---|---|---|---|
| Comparative Example 1 FIG. 10A | 1 | 0.445 | 0.353 | 0.399 | 0.420 | 0.090 |
| | 2 | 0.521 | 0.457 | 0.489 | | |
| | 3 | 0.456 | 0.408 | 0.432 | | |
| Comparative Example 2 FIG. 10B | 4 | 0.280 | 0.260 | 0.270 | 0.268 | 0.021 |
| | 5 | 0.323 | 0.232 | 0.278 | | |
| | 6 | 0.276 | 0.238 | 0.257 | | |
| Example FIG. 10C | 7 | 0.568 | 0.452 | 0.510 | 0.508 | 0.028 |
| | 8 | 0.544 | 0.488 | 0.521 | | |
| | 9 | 0.550 | 0.435 | 0.493 | | |

A. UP torque: piezoelectric body support torque when pushing downward from upper amplitude position to central position
B. DW torque: piezoelectric couple support torque when pushing upward from lower amplitude position to central position
C. total stroke: difference between upper and lower amplitudes
D. A × C: product of UP torque and total stroke
E. B × C: product of DW torque and total stroke
F. (D + E)/2: average of products of respective torques and total strokes
Average value of F: average value of F values of three samples
Difference: difference between maximum and minimal F values of three samples The larger the average value indicated by F in Table 4 of the upper and lower products of the total strokes and torques, the more the vibration in the widthwise direction of the piezoelectric body is suppressed, so that the vibration in the longitudinal direction of the piezoelectric body is exhibited more effectively.

It is apparent from Table 4 that the average value of F of the example increases by about 20% the average value of F of Comparative Example 1, and that the variations among the three samples of the example are greatly improved when compared to Comparative Example 1.

It is confirmed with this experiment that if the rotary member discontinues in the widthwise direction as in Comparative Example 2, when a voltage is applied to the piezoelectric body, suppression of the vibration in the widthwise direction decreases largely when compared to Comparative Example 1 in which the rotary member is continuous in the widthwise direction.

Figure 11:
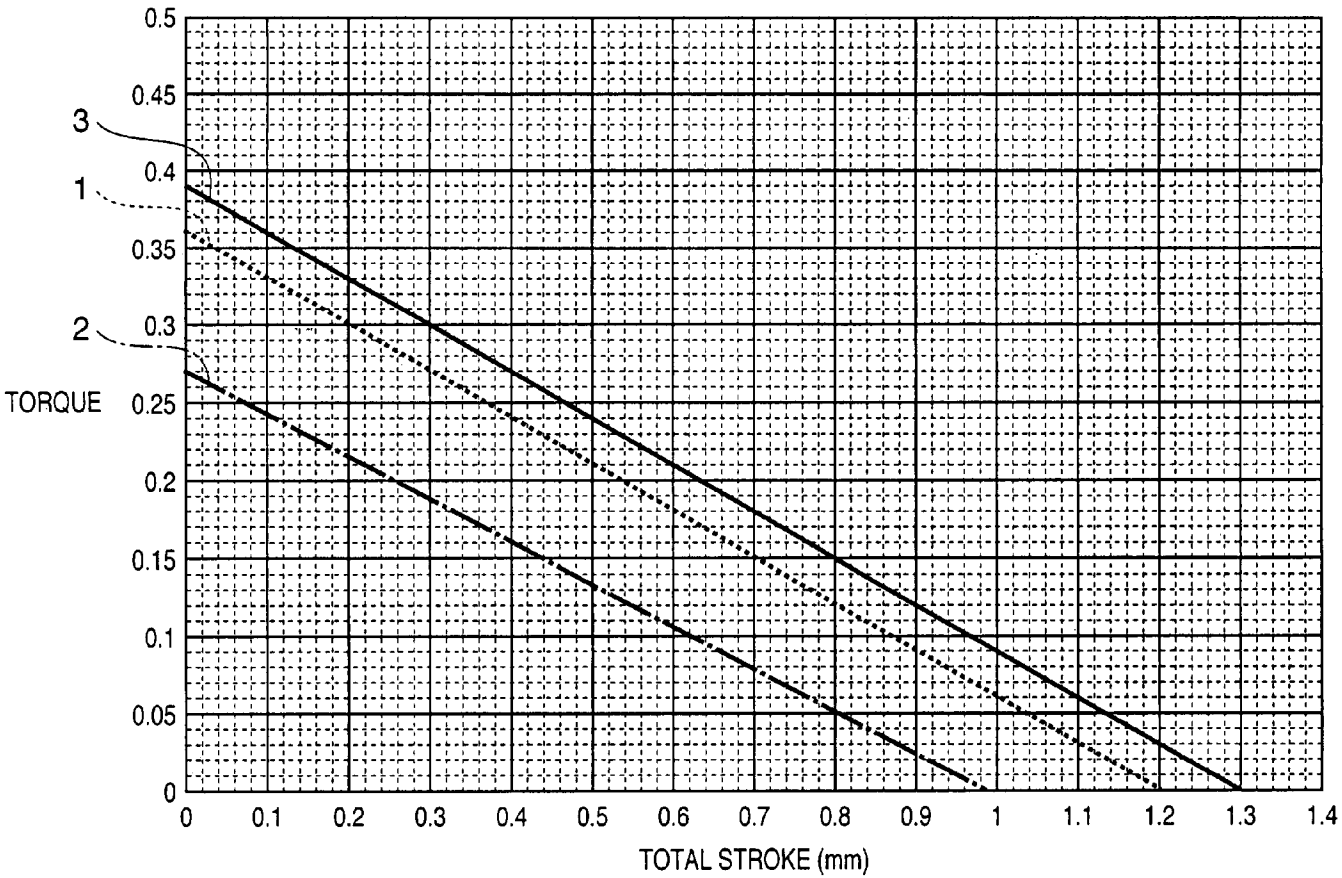
FIG. 11 is a graph showing the relationship between the stroke and torque which are affected when the shape of the rotary member which holds the piezoelectric body at the intermediate position is changed.

In performing this experiment, the relationship between the torque and stroke of each sample was examined. FIG. 11 shows the result. Among lines each representing the relationship between the torque and stroke, a broken line 1 shows Comparative Example 1, an alternate long and short dashed line 2 shows Comparative Example 2, and a solid line 3 shows the example.

In FIG. 11, the larger the area under a straight line representing the relationship between the torque and stroke, the more the vibration in the widthwise direction of the piezoelectric body is suppressed, so that the vibration in the longitudinal direction of the piezoelectric body operates more effectively. In FIG. 11, the solid line 3 representing the relationship between the torque and stroke of the example is located at the highest position. This proves that a piezoelectric body provided with a rotary member according to the present invention exhibits an excellent result in terms of the vibration of the piezoelectric body that cannot be conventionally obtained.

Figure 9C:
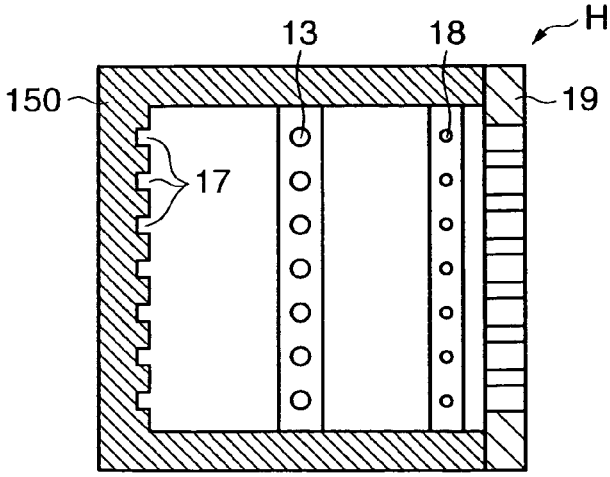
FIG. 9C is a schematic view showing an example of a housing, in the needle selector for the knitting machine in the embodiment, in which a plurality of piezoelectric bodies are arranged to form layers.

The novel needle selector for the knitting machine according to the present invention has been described in detail through a case wherein one piezoelectric body is used. Actually, as is easily understood by a person skilled in the art, in a mass-production knitting machine, one piezoelectric body is not held by a support body. As shown in, e.g., FIG. 9C, a housing is used in which a plurality of piezoelectric bodies (seven piezoelectric bodies in the case of FIG. 9C) are arranged at spaces among them to form a layer. Hence, the needle selector for the knitting machine of the present invention refers to a needle selector in which at least one piezoelectric body is accommodated in a support body or housing.

Although the needle selector for the knitting machine of the present invention is described exemplifying the case wherein the needle selector is used in a circular knitting machine, the needle selector of the present invention can also be used in a flat knitting machine.

INDUSTRIAL APPLICABILITY

The needle selector for the knitting machine according to the present invention is based on a needle selector for a knitting machine which is registered by the applicant of the present invention as Japanese Patent No. 1969970 (see Japanese Patent Publication No. 6-94619) and counterpart U.S. Pat. No. 5,027,619 and widely used as a very excellent apparatus. Furthermore, since the rotary member which hold the piezoelectric body at the intermediate position is formed such that the bend in the widthwise direction of the piezoelectric body is suppressed to be smaller than the bent in the longitudinal direction of the piezoelectric body, the piezoelectric body can be vibrated more efficiently.

As a result, the vibration speed of the piezoelectric body can be increased, and an increase in productivity of the knitting machine can be achieved.

The present invention is not limited to the above embodiments and various changes and modifications can be made within the spirit and scope of the invention. Therefore, to apprise the public of the scope of the present invention, the following claims are made.

The invention claimed is:

1. A needle selector for a knitting machine, which comprises a plate-like piezoelectric body having a piezoelectric element and a finger aligned with said piezoelectric body and disposed to be movable, and in which a rear end portion of said piezoelectric body is rotatably supported in a groove of a support body or housing, a front end portion of said piezoelectric body is rotatably connected to a rear end portion of said finger, an intermediate position between said rear end portion and front end portion of said piezoelectric body is clamped by a rotary member rotatably provided to said support body or housing, and said finger is actuated by applying a voltage to said piezoelectric element to select a working needle of said knitting machine, so that a fabric having a predetermined pattern texture can be knitted, characterized in that said rotary member comprises shaft necks formed at two ends thereof to be supported by bearings provided to said support body or housing, and a central portion between said two shaft necks, and a slit which clamps said piezoelectric body is formed in at least part of said central portion in a widthwise direction of said piezoelectric body, and an axial sectional structure of said central portion on a plane which is perpendicular to an axis of said rotary member and perpendicular to a plane of said piezoelectric body is formed such that a bend in the widthwise direction of said piezoelectric body is suppressed to be smaller than a bend in a longitudinal direction of said piezoelectric body.

2. The needle selector for the knitting machine according to claim 1, characterized in that said central portion has such a sectional shape that a length thereof along a direction that connects said rear end portion and front end portion of said piezoelectric body is smaller than a length along a thickness direction of said piezoelectric body.

3. The needle selector for the knitting machine according to claim 2, characterized in that said sectional shape of said central portion comprises an ellipse which has a short side in the direction that connects said rear end portion and front end portion of said piezoelectric body.

4. The needle selector for the knitting machine according to claim 1, characterized in that said sectional shape of said central portion has a rib-like projection, either or both on and under said central portion, at a position away from the slit.

5. The needle selector for the knitting machine according to claim 1, characterized in that said central portion is formed of not less than two layers, in a sectional structure thereof, which are made of materials having different bending rigidities, and a material having a higher bending rigidity than a material used in a portion close to the slit is employed to form a portion away from the slit.

6. The needle selector for the knitting machine according to claim 5, characterized in that said portion away from the slit is formed of a rod-shaped member made of a metal, and the portion close to the slit is made of a plastic material.

* * * * *